United States Patent [19]

Fedele

[11] 4,357,878

[45] Nov. 9, 1982

[54] FLUID LOAD DISTRIBUTION SYSTEM

[75] Inventor: Franco Fedele, Florence, Italy

[73] Assignee: Norca Corporation, Great Neck, N.Y.

[21] Appl. No.: 119,219

[22] Filed: Feb. 7, 1980

[51] Int. Cl.[3] ..... B60P 3/40; B61F 3/00; B61F 5/24

[52] U.S. Cl. ..... 105/159; 105/164; 105/183; 410/45; 410/53

[58] Field of Search ..... 105/3, 159, 164, 183, 105/199 R; 410/44, 45, 53

[56] References Cited

U.S. PATENT DOCUMENTS

| | | | |
|---|---|---|---|
| 2,095,677 | 10/1937 | Schoepf et al. | 105/164 |
| 3,532,061 | 10/1970 | Bohm | 105/159 X |
| 3,648,622 | 3/1972 | Lich | 410/53 |
| 3,837,295 | 9/1974 | Fedele | 410/45 |
| 3,896,740 | 7/1975 | Kreissig | 105/164 |
| 4,113,111 | 9/1978 | Theurer et al. | 105/164 X |
| 4,164,906 | 8/1979 | Nieviarovski | 410/44 X |

*Primary Examiner*—Joseph F. Peters, Jr.
*Assistant Examiner*—Howard Beltran
*Attorney, Agent, or Firm*—Shenier & O'Connor

[57] ABSTRACT

A load distribution system for railway cars, in which the load is applied to the supporting structure by fixed bearing arrangements, at one pair of longitudinally spaced points, at one side of the center line of the structure and is applied to the supporting structure at another pair of correspondingly longitudinally spaced points at the other side of the center line of the structure, and aligned with the first pair of points by a pair of hydraulic cylinders which are connected to each other in a closed hydraulic system. In effect my arrangement converts a statistically indeterminate four point suspension to a statistically determinant three point suspension.

7 Claims, 8 Drawing Figures

FLUID LOAD DISTRIBUTION SYSTEM

BACKGROUND OF THE INVENTION

In railway freight car supporting structures of the prior art, the load is transmitted to the supporting structure at longitudinally spaced pairs of transversely spaced points making up four points in all. Generally at the location of each pair of points, there is provided a vertically extending pin for absorbing thrust in the longitudinal direction and, at each side of the pin, a vertical load-supporting structure.

While the load-supporting structures of the prior art operate satisfactorily for the most part for normal cars under normal operating conditions, in some instances the arrangements give rise to conditions under which derailments may occur. This problem is particularly severe in the case of relatively long cars, such as schnabel cars and other multi-axle cars when they are moving into a banked curve or other similar conditions. Under this condition a torsional force is applied to the supporting structure with the result that the load on a diagonal line between the high wheel moving into the curve and the rear wheel which is located on a diagonal with reference to the high wheel, increases. Correspondingly, it is reduced at the other wheels. This condition creates a tendency for the unloaded wheels to move upwardly off the rails, with the consequent danger of derailment.

SUMMARY OF THE INVENTION

One object of my invention is to provide an improved load distribution system for railway cars.

Another object of my invention is to provide an improved load distribution system for railway cars which is more stable than are load distribution systems of the prior art.

A further object of my invention is to provide a load distribution system for railway cars, which reduces the danger of derailments as the car negotiates a banked curve.

Still another object of my invention is to provide an improved load distribution for railway cars, which results in a more stable operation than do systems of the prior art.

Other and further objects of my invention will appear from the following description:

In general my invention contemplates the provision of a load distribution system for railway cars, in which the load is applied to the supporting structure by fixed bearing arrangements, at one pair of longitudinally spaced points, at one side of the center line of the structure and is applied to the supporting structure at another pair of correspondingly longitudinally spaced points at the other side of the center line of the structure, and aligned with the first pair of points by a pair of hydraulic cylinders which are connected to each other in a closed hydraulic system. In effect my arrangement converts a statistically indeterminate four point suspension to a statistically determinant three point suspension.

BRIEF DESCRIPTION OF THE DRAWINGS

In the accompanying drawings to which reference is made in the instant specification and which are to be read in conjunction therewith and in which like reference characters are used to indicate like parts and various views:

FIG. 3 is a side elevation of the apparatus illustrated in FIG. 1 with parts broken away and with other parts shown in section.

DESCRIPTION OF THE PREFERRED EMBODIMENT

Figure 1:
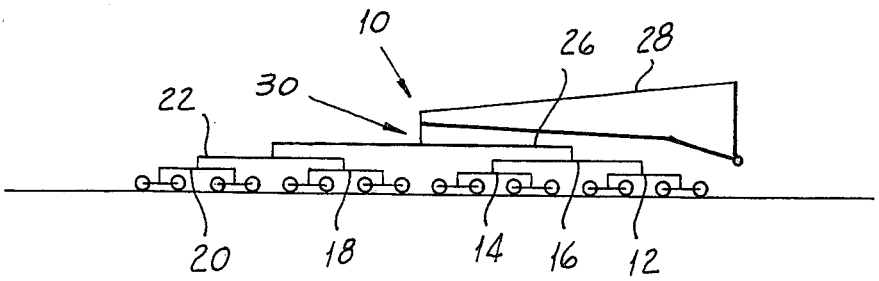
FIG. 1 is a schematic view of one form of railway car to which my invention may be applied.

Referring now to FIG. 1, one specific form of railway car to which my invention may be applied is a schnabel car, one-half of which is shown in FIG. 1. Cars of this type are more fully shown and described in my prior U.S. Pat. No. 3,837,295 and in Nieviarovski U.S. Pat. No. 4,164,906. The particular car half indicated generally by the reference character 10 shown in FIG. 1 includes a pair of inboard four-axle trucks 12 and 14 to which the load is applied by means of an inboard lower span bolster 16. A pair of outboard four-axle trucks 18 and 20 receive the load in a manner to be described through an outboard lower span bolster 22. The span bolsters 16 and 22 receive the load in a manner to be described from an upper span bolster 26 to which the load is applied through a pivotal connection 30 from a schnabel beam 28.

Figure 2:
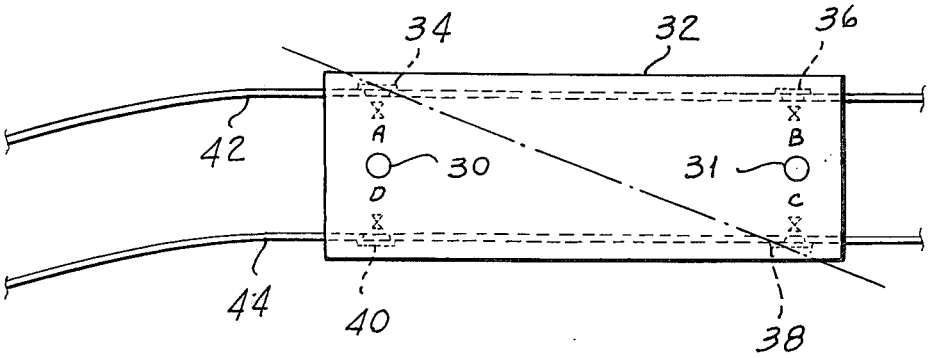
FIG. 2 is a schematic view illustrating the principle of operation of my invention.

Referring now to FIG. 2, by way of illustration, I have shown a body 32 having four wheels 34, 36, 38, and 40, by means of which the body is supported for movement along rails 42 and 44. In the prior art vertical load is applied at center plates 30 and 31 and at points A, B, C, and D, at which there are disposed bearings having a nominal spacing between the elements thereon. Under various conditions the load is distributed among various combinations of these six points. In the usual arrangement of my invention, the coupling between the wheels and the load-carrying member includes center pins 30 and 31 which, while they absorb longitudinal thrust, do not carry the load. The load normally is applied to the wheels at points indicated by A, B, C, and D adjacent to the corners of the body 32 in FIG. 2, at which points are located bearings the elements of which normally contact each other. Under normal operating circumstances where the body 32 is running over a generally straight and level track portion, the load is equally distributed among all the points A, B, C, and D. As is known, railway curves are banked so that the outboard rail at the turn is elevated with respect to the inboard rail. In the arrangement of the prior art this condition produces an unequal distribution of the forces at the points of application to the body 32 with the result that the danger of derailments is increased. It will readily be appreciated that as the wheel 34 adjacent to the point A moves into the part of the rail 42 at the curve, the load thereon increases, while the load on wheel 36 decreases. There is, in effect, a torsional moment applied to the body 32 which causes the wheel 36, for example, to tend to lift off the rail with the resultant danger of derailment. This problem is particularly severe in the case of relatively long cars such, for example, as a schnabel car. As indicated by the diagonal dot-dash line in FIG. 2, the increase in load on wheel 34 as it enters the curve is shared by wheel 38. By the same token, the load on wheel 40 decreases.

Figure 4:
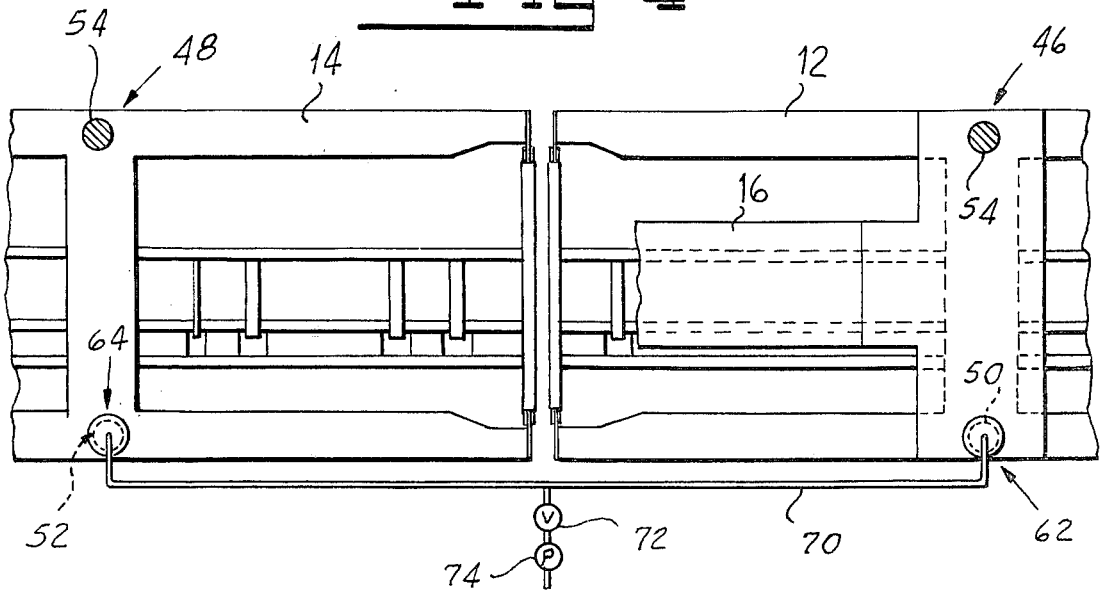
FIG. 4 is a sectional view of the portion of the apparatus illustrated in FIG. 3 taken along the line 4—4 in FIG. 3 with part of one of the intermediate bolsters and parts of two of the trucks broken away.
Figure 1:
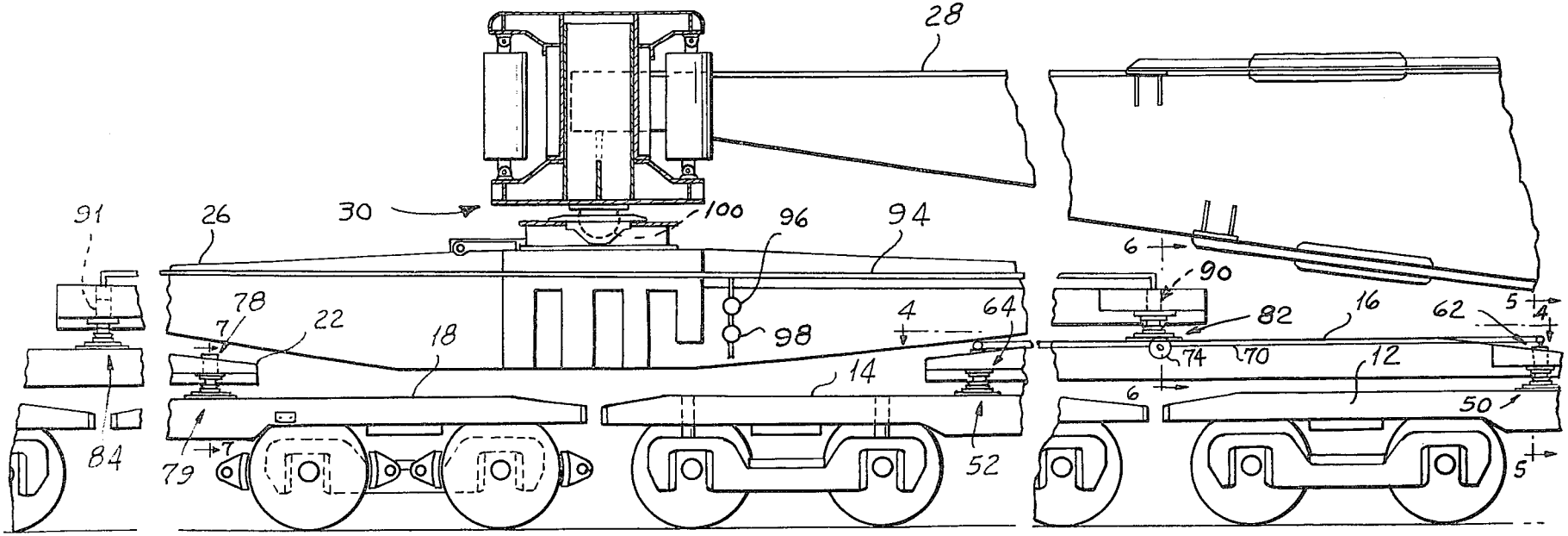
Figure 5:
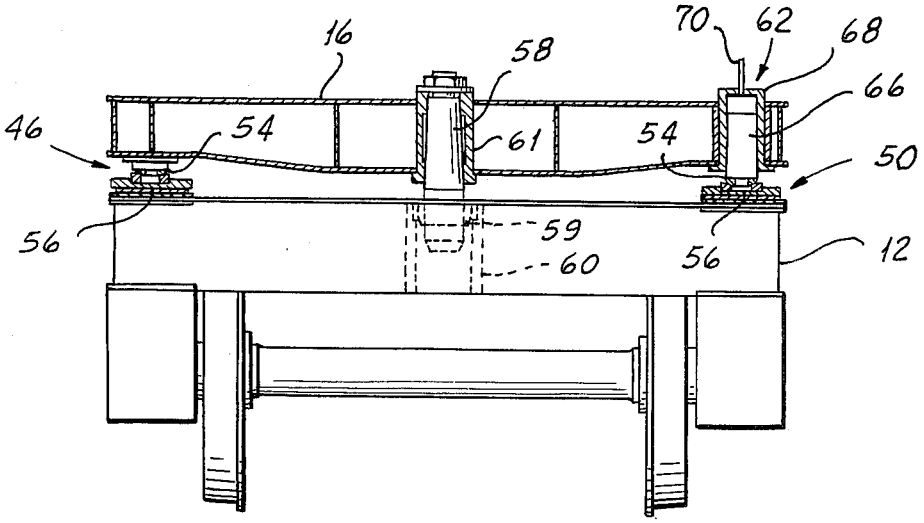
FIG. 5 is a sectional view of the apparatus shown in FIG. 3 taken along the line 5—5 thereof.

Referring now to FIGS. 3 to 5, in my arrangement for equalizing the load distribution on railway cars, I dispose respective spherical load applying bearings indicated generally by the reference characters 46 and 48 between trucks 12 and 14 and the inner lower span bolster 16 along one side thereof. I provide second spherical load applying bearings, indicated generally by the reference characters 50 and 52 between the bolster 16 and the trucks 12 and 14 along the other side of the bolster. Each of the spherical bearings 46, 48, 50, and 52 includes a male part 54 and a female part 56. Each of the connections between the lower inboard span board 16 and the trucks 12 and 14 includes a centering pin 58, which may, for example, be guided in a spherical bearing 59 assembled in a bearing housing 60 on truck 12 and which is adapted to extend upwardly into a conical housing 61 on the span bolster 16. As has been pointed out hereinabove, pin 58 is not intended to carry any of the vertical load but only to absorb horizontal forces.

In my arrangement, the bearings 46 and 48 are carried by the span bolster 16 and slide bearings are disposed between bearings 46 and 48 and the trucks 12 and 14. I so arrange pin 58 relative to its guide 61 that the elements 54 fully engage the elements 56 under normal operating conditions.

I mount the elements 54 of bearings 50 and 52 on the piston 66 of respective piston and cylinder assemblies, indicated generally by the reference characters 62 and 64. The elements 56 of bearings 50 and 52 rest on slide bearings on trucks 12 and 14. Each of these piston cylinder assemblies 62 and 64 include a cylinder 68 supported by the lower inner span bolster 16. I connect the chambers of the cylinders 68 above the piston 66 in a closed system. More specifically, a common line 70 connects the two chambers. Fluid under pressure from a suitable source may be pumped into the line 70 by means of a pump 74 through a valve 72.

While I have described an arrangement in which the spherical bearings are carried by the upper member, in this case bolster 16, with slide bearings on the lower members, such as trucks 12 and 14, it will readily be appreciated that the arrangement could be reversed.

The operation of the two cylinders 62 and 64 in equalizing the pressure distribution will readily be apparent. Assuming that the car is travelling to the right as viewed in FIGS. 3 and 4 and that a curve to the left is approached, the load at the location of bearing 50 would tend to increase and the load at bearing 52 would tend to decrease. At the same time, the load at bearing 46 would tend to decrease and the load at bearing 48 would tend to increase. My system readily compensates for this condition by permitting the flow of fluid from the space above the piston of assembly 62 to the space above the piston 66 of the assembly 64. My arrangement thus automatically ensures that the load at all four bearings remains substantially the same as the car moves around the curve.

Figure 7:
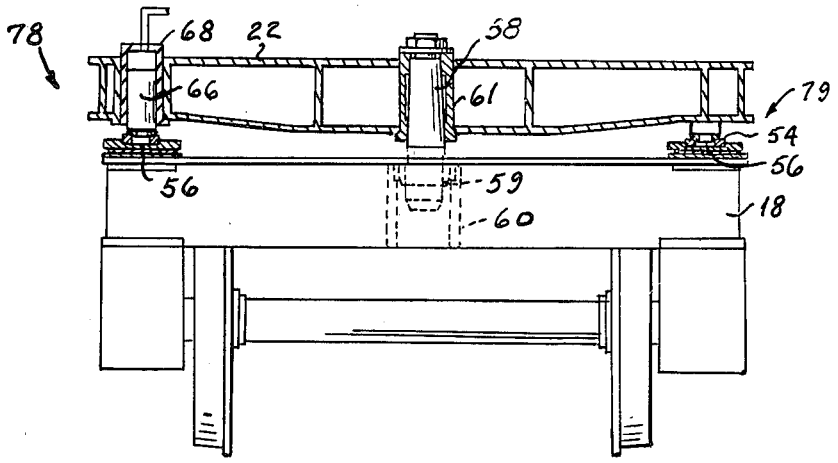
FIG. 7 is a sectional view taken along the line 7—7 of FIG. 3.
Figure 8:
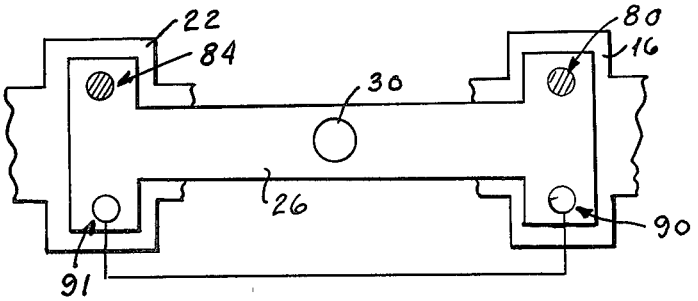
FIG. 8 is a diagrammatic view illustrating the manner in which the load is transferred from the main bolster to the intermediate bolsters of the assembly.

Preferably, I employ my system at the number of locations where a relatively long car, such as the schnabel car half 10 is involved. For this reason, I use a similar arrangement at the couplings between the outboard lower span bolster 22 and the trucks 18 and 20. For example, at the coupling between truck 18 and bolster 22 at the near side as viewed in FIG. 3, I provide a spherical bearing indicated generally by the reference character 79, carried by the bolster 22. At the far side as viewed in FIG. 3 of the connection between truck 18 and bolster 22, I provide another spherical bearing (not shown). In this instance, however, I employ a piston and cylinder assembly indicated generally by the reference character 78 for connecting one of the bearing elements to the bolster 22. It will be appreciated from the structure just described that I stagger the load equalizing cylinder assemblies in the direction of the car length. That is to say, each of the cylinder assemblies 62 and 64 between the inner lower span bolster 16 and the trucks 12 and 14 are at the near side as viewed in FIG. 3, while the cylinder assembly such as 78 between trucks 18 and 20 and the outboard or bolster are at the far side as viewed in FIG. 3 as shown in FIG. 7. As an alternative to the mode of staggering the piston and cylinder assemblies, I may stagger them from layer to layer vertically as dictated by conditions.

Figure 6:
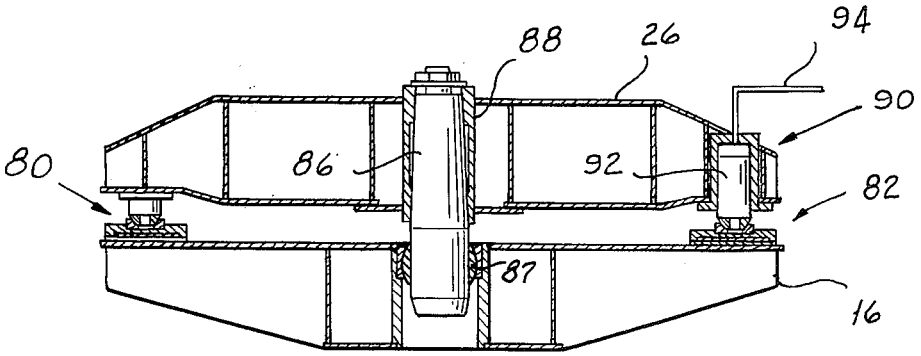
FIG. 6 is a sectional view of a portion of the apparatus illustrated in FIG. 3 taken along the line 6—6 thereof.

In addition to providing my load equalizing arrangement between each of the lower span bolsters and the trucks, I find it desirable to employ the same arrangement for coupling the upper span bolster 26 to the two lower span bolsters 16 and 22. Referring to FIGS. 3 and 6, I dispose respective spherical bearings 80 and 82 between the upper bolster 26 and the inner lower bolster 16 at the sides thereof. I provide other spherical bearings, one bearing 84 of which is shown in the drawings for connecting the upper span bolster 26 to the outboard lower span bolster 22 at the sides thereof. In the particular arrangement illustrated in the drawings, the bearings such as 80 are carried by the span bolster 26 and rests on slide bearings on the span bolsters 16 and 22. Each of the couplings between the span bolster 26 and span bolsters 16 and 22 include a thrust absorbing pin 86 which may, for example, be guided in a spherical bearing 87 carried by span bolster 16. A housing 88 on the bolster 26 receives the pin. As has been explained hereinabove, I so construct my system that the elements of the bearings 80 are fully seated in normal operation of the system.

I provide respective piston and cylinder assemblies indicated generally by the reference characters 90 and 91 associated with the bearings 82 and 84. The piston 92 of each of these assemblies carries the male element of the bearings 82 or 84. A common line 94 connects the spaces over the piston 92. Fluid under pressure from a suitable source may be supplied to the line 94 by means of a pump 98 acting through a valve 96.

The coupling 30 between the outboard end of the schnabel beam 28 and the span bolster 26 includes a spherical bearing 100 and other structure which will not be described in detail since it does not, per se, perform part of my invention. However, the structure 28 can be supported by an arrangement according to my invention as shown in FIG. 4. Moreover, this support and the corresponding one on the other car half might be the only ones so supported since they are the furthest apart of load points.

The operation of my improved railway car load distribution system can best be understood by reference to FIG. 2. Assuming that the body 32 is moving from right to left on rails 42 and 44 and is approaching a banked turn to the left. As the body enters the turn the load on wheel 34 will greatly increase as will the load on the diagonally opposite wheel 38. At the same time, the load on the wheels 36 and 40 will be decreased. As has been pointed out hereinabove, this situation creates the possibility of a derailment, particularly in the instance in which the car is a relatively long one. If in the instance shown the load is applied from the body 32 to the wheel assemblies at points A and B through interconnected piston and cylinder assemblies, some of the load increase at wheel 34 will be translated to wheel 36, until the load is equally distributed among all of the points A, B, C, and D. It will readily be appreciated that as an alternative to applying the load at points A and B through interconnected hydraulic piston and cylinder assemblies, I could apply the loads at points C and D through interconnected piston and cylinder assemblies. In the specific embodiment of my system illustrated in the drawings, fluid under pressure is introduced initially into the cylinder 68 of the piston and cylinder assemblies 62 and 64 by pump 74 through valve 72 until the load is equally distributed on all of the spherical bearings 46, 48, 50, and 52 with the car assembly on a flat section of track. The other piston and cylinder assemblies 78 and 90 similarly are supplied with fluid under pressure until the load is equally distributed among all of the bearings associated with these assemblies when the car assembly is on a flat portion of track. It will readily be appreciated that this operation of adding fluid to the various piston and cylinder assemblies is an initial operation only, which is done prior to the time the cars are put in service, or to replenish any fluid which may have leaked out. The filling of the cylinders per se has nothing to do with the force equalizing action in the course of which the hydraulic systems are closed. Whenever the car enters a banked curve, these piston and cylinder assemblies act in the manner described hereinabove in connection with the showing of FIG. 2 to equalize the load distribution at all of the bearings.

It will be seen that I have accomplished the objects of my invention. I have provided a load distribution system for railway cars, which equalize the load distribution among all bearing points when the car assembly enters a banked turn or similar rail conditions. My load distribution system for railway cars reduces the danger of derailment when a car enters a banked curve. My load distribution system for railway cars is especially adapted for use with long car assemblies or where cross-rail elevation changes substantially over the car length.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A load equalizing system for inhibiting the application of a torsional load to a railway car adapted to move along a track made up of a pair of rails and having a banked curve including in combination, a first truck having respective wheels adapted to run along said rails, a second truck having respective wheels adapted to run along said rails, and load applying means including a span bolster extending between said trucks to form an assembly having a nominal longitudinal centerline when the trucks are on a straight portion of said track, a pair of first transversely spaced bearings on opposite sides of said longitudinal centerline for transmitting vertical load from said span bolster to said first truck, a pair of second transversely spaced bearings on opposite sides of said centerline for transmitting vertical load from said span bolster to said second truck, each of said bearings comprising a pair of normally contacting solid elements, means mounting one element of each of the first and second bearings on one side of said longitudinal centerline directly and rigidly on said span bolster for movement therewith, means mounting the other elements of said first and second bearings on said one side of said centerline directly and rigidly on the respective first and second trucks for movement therewith and force transmitting means actuated by said banked curve as said car negotiates said curve interconnecting corresponding elements of the first and second bearings only on the other side of said longitudinal centerline for equalizing the load on said first and second bearings.

2. A system as in claim 1 in which said force transmitting means comprises respective fluid couplings between said corresponding elements of said first and second bearings and said span bolster and means interconnecting said couplings in a closed system.

3. A load equalizing system for inhibiting the application of a torsional load to a railway car adapted to move along a track made up of a pair of rails and having a banked curve including in combination, a first truck having respective wheels adapted to run along said track, a second truck having respective wheels adapted to run along said track, load applying means interconnecting said trucks to provide an assembly having a nominal longitudinal centerline when the trucks are on a straight portion of said track, said load applying means comprising a first pair of transversely spaced load bearers on opposite sides of said longitudinal centerline for applying vertical load to said first truck, a second pair of transversely spaced load bearers on opposite sides of said longitudinal centerline for applying vertical load to said second truck, and force transmitting means actuated by said banked curve as said car negotiates said curve interconnecting only those of said load bearers located at the same side of said longitudinal centerline to equalize the load on said load bearers.

4. A system as in claim 3 in which said force transmitting means comprises respective hydraulic couplings associated with said load bearers located at the same side of said centerline and means interconnecting said hydraulic couplings in a closed system.

5. In a railway car adapted to move along a way having a banked curve, an assembly having a nominal longitudinal centerline when said car is on a straight portion of said way, said assembly inhibiting the application of a torsional load to said car, said assembly including in combination, an elongated bolster, a first body supported for movement along said way, a second body supported for movement along said way, a pair of first transversely spaced bearings on opposite sides of said longitudinal centerline for transmitting vertical load from said bolster to said first body, a pair of second transversely spaced bearings on opposite sides of said centerline for transmitting vertical load from said bolster to said second body, each of said bearings comprising a pair of normally contacting solid elements, means mounting one element of each of the first and second bearings on one side of said longitudinal centerline directly on said bolster for movement therewith, means mounting the other elements of said first and second bearings on said one side of said centerline directly on the respective first and second bodies for movement therewith, and force transmitting means actuated by said banked curve as said assembly negotiates said curve interconnecting corresponding elements of the first and second bearings only on the other side of said longitudinal centerline for equalizing the load on said first and second bearings.

6. In a load equalizing system for inhibiting the application of a torsional load to a railway car adapted to move along a track made up of a pair of spaced rails and incorporating a banked curve, an assembly having a nominal longitudinal centerline when on a straight portion of said way, said assembly comprising a first truck having wheels adapted to move along said rails, a second truck having wheels adapted to move along said rails, a first intermediate bolster spanning said first and second trucks, a pair of first transversely spaced vertical load applying bearings between said first intermediate bolster and said first truck on opposite sides of said longitudinal centerline, a pair of second transversely spaced vertical load applying bearings disposed between said first intermediate bolster and said second truck on opposite sides of said centerline, each of said first and second bearings comprising a pair of normally contacting solid elements, means mounting one element of each of the first and second bearings on the same side of said longitudinal centerline directly on said first intermediate bolster for movement therewith, means mounting the other elements of said first and second bearings on said same side of said longitudinal centerline directly on the first and second respective trucks for movement therewith, force transmitting means actuated by said banked curve as said assembly negotiates said curve interconnecting corresponding elements of the first and second bearings only on the other side of said longitudinal centerline opposite said same side to equalize the load on said first and second bearings, a third truck having wheels adapted to move along said rails, a fourth truck having wheels adapted to move along said rails, a second intermediate bolster spanning said third and fourth trucks, a pair of third transversely spaced vertical load applying bearings disposed between said second intermediate bolster and said third truck on opposite sides of said longitudinal centerline, a pair of fourth transversely spaced vertical load applying bearings disposed between said second intermediate bolster and said fourth truck on opposite sides of said longitudinal centerline, each of said third and fourth bearings comprising a pair of normally contacting solid elements, means mounting one element of each of the third and fourth bearings on the same side of said longitudinal centerline directly on said second intermediate bolster for movement therewith, means mounting the other elements of said third and fourth bearings on said last-named same side of said longitudinal centerline directly on the third and fourth respective trucks for movement therewith, force transmitting means actuated by said banked curve as said assembly negotiates said curve interconnecting corresponding elements of the third and fourth bearings only on the other side of said longitudinal centerline opposite to said last-named same side to equalize the load on said third and fourth bearings, a main bolster spanning said first and second intermediate bolsters, a pair of fifth transversely spaced vertical load applying bearings between said main bolster and said first intermediate bolster on opposite sides of said longitudinal centerline, a pair of sixth transversely spaced vertical load applying means between said main bolster and said second intermediate bolster on opposite sides of said centerline, each of said fifth and sixth bearings comprising a pair of normally contacting solid elements, means mounting one element of each of the fifth and sixth bearings on the same side of said longitudinal centerline directly on said main bolster for movement therewith, means mounting the other elements of said fifth and sixth bearings on said last-named same side of said longitudinal centerline directly on the first and second respective intermediate bolsters for movement therewith, force transmitting means actuated by said banked curve as said assembly negotiates said curve interconnecting corresponding elements of the fifth and sixth bearings only on the other side of said longitudinal centerline opposite to said last-named same side to equalize the load on said fifth and sixth bearings.

7. A system as in claim 6 in which said force transmitting means are laterally staggered with reference to said longitudinal centerline.

* * * * *